US007073967B2

(12) United States Patent
Choi et al.

(10) Patent No.: US 7,073,967 B2
(45) Date of Patent: Jul. 11, 2006

(54) WRITING INSTRUMENT

(75) Inventors: Sung-Ho Choi, Ansan (KR); Jea-Hyun Shim, Seoul (KR); Kwan-Ho Kang, Ansan (KR)

(73) Assignee: Monami Co., Ltd., Seoul (KR)

( * ) Notice: Subject to any disclaimer, the term of this patent is extended or adjusted under 35 U.S.C. 154(b) by 0 days.

(21) Appl. No.: 11/041,116

(22) Filed: Jan. 24, 2005

(65) Prior Publication Data

US 2005/0276654 A1 Dec. 15, 2005

(30) Foreign Application Priority Data

Jun. 15, 2004 (KR) ..... 10-2004-0043905

(51) Int. Cl.
*B43K 5/00* (2006.01)
*B43K 5/18* (2006.01)

(52) U.S. Cl. ..... 401/199; 401/198; 401/225

(58) Field of Classification Search ..... 401/198, 401/199, 225, 224, 229, 230
See application file for complete search history.

(56) References Cited

U.S. PATENT DOCUMENTS 3,922,100 A * 11/1975 Saito ..... 401/199
5,906,446 A * 5/1999 McCulloch et al. ..... 401/199
6,497,527 B1 * 12/2002 Kaufmann ..... 401/198

* cited by examiner

*Primary Examiner*—David J. Walczak
(74) *Attorney, Agent, or Firm*—Park Law Firm; John K. Park

(57) ABSTRACT

A writing instrument can prevent ink stored in an ink intake retainer body from flowing toward an air passage due to volume expansion, shock, etc., of the ink, thereby preventing the stoppage of the air passage and the ink from flowing outside the body. The writing instrument includes, an ink tank, an ink intake retainer body, a tubular drawing tip, and an ink drain restriction body, which has greater porosities than those of the ink intake retainer body. The ink drain restriction body is formed on the part of an air passage of the ink intake retainer body. Therefore, the ink drain restriction body for absorbing and storing the ink, which is drained toward the air passage due to volume expansion, shock flow, etc., is provided in the rear of the ink intake retainer.

7 Claims, 3 Drawing Sheets

WRITING INSTRUMENT

CROSS-REFERENCE TO RELATED APPLICATION

This application claims benefit under 35 U.S.C. § 119 from Korean Patent Application No. 10-2004-0043905, filed on Jun. 15, 2004, the entire content of which is incorporated herein by reference.

BACKGROUND OF THE INVENTION

1. Field of the Invention

The present invention relates to a writing instrument, and more particularly, to a writing instrument including an ink tank, an ink intake retainer body, a tubular drawing tip, and an ink drain restriction body for absorbing volume expansion caused by variation in temperature of ink, which is absorbed in the ink intake retainer body, wherein the ink drain restriction body is disposed on the part of an air passage of the ink intake retainer body, whereby the ink is prevented from flowing toward the air passage by means of its weight when the writing instrument is carried upside down.

2. Background of the Related Art

Generally, a writing instrument includes an ink tank for containing ink, and a tubular drawing tip for drawing the ink contained in the ink tank by way of a capillary phenomenon for writing purpose.

Meanwhile, as described above, if the ink is directly supplied from the ink tank to the tubular drawing tip, it becomes difficult to control the outflow of the ink through the tubular drawing tip. In this connection, in order to prevent excessive outflow of the ink, an ink intake retainer body for temporarily storing the ink supplied from the ink tank is disposed between the tubular drawing tip and the ink tank.

An air passage for enabling the ink to flow smoothly is further formed in the rear of the ink intake retainer body on the part of the tubular drawing tip body.

In the writing instrument constructed above, the ink contained in the ink retainer tank is absorbed/stored by/in the ink intake retainer body, and then flows toward the tubular drawing tip, so that writing is accomplished.

However, as stated previously, if ambient temperature varies while using such a conventional writing instrument having a mixing ball provided in the ink retainer tank, the ink, which is absorbed/stored by/in the ink intake retainer body, flows toward the air passage by means of volume expansion. In this case, however, there are problems in that the flowed ink stops the air passage and flows outside the body because of wetting by viscosity with the surface of the body.

Furthermore, if the writing instrument is held upside down or applied with shock from the back, the ink stored in the ink intake retainer body flows toward the air passage by way of inertia flow. Accordingly, there are problems in that the flowed ink plugs the air passage and flows outside the body because of wetting by viscosity with the surface of the body.

SUMMARY OF THE INVENTION

Accordingly, the present invention has been made in view of the above problems, and it is an object of the present invention to provide a writing instrument capable of preventing ink stored in an ink intake retainer body from flowing toward an air passage due to volume expansion, shock, etc., of the ink, thereby preventing the stoppage of the air passage and the ink from flowing outside the body.

Another object of the present invention is to provide a writing instrument including an anti-absorption layer, which has a surface active agent coated on and is disposed on a contact surface on the part of an ink intake retainer body of an ink drain restriction body, whereby ink can be prevented from flowing toward an air passage by maximum, and air can be supplied to the ink intake retainer body smoothly.

Still another object of the present invention is to provide a writing instrument including a drain interception body, which has denser porosities than those in an ink drain restriction body, and is formed on the part of an air passage of an ink drain restriction body, whereby ink absorbed in the ink drain restriction body due to volume expansion, shock flow, etc. is prevented from flowing toward an air passage because of wetting, etc. by viscosity with the body.

Still another object of the present invention is to provide a writing instrument including a retaining tubular cap, which is provided in the rear of an ink drain restriction body, thus preventing ink introduced due to volume expansion, shock flow, etc. from flowing toward an air passage.

To achieve the above objects, according to the present invention, there is provided a writing instrument having an ink tank, an ink intake retainer body and a tubular drawing tip, including an ink drain restriction body, which has greater porosities than those of the ink intake retainer body and thus has a lower density than that of the ink intake retainer body, wherein the ink drain restriction body is formed on the part of an air passage of the ink intake retainer body.

Therefore, the ink drain restriction body for absorbing and storing the ink, which is drained toward the air passage due to volume expansion, shock flow, etc., is provided in the rear of the ink intake retainer. It is thus possible to prevent the air passage from being stopped due to the ink drained toward the air passage and the ink from flowing outside the ink drain restriction body.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

The present invention will now be described in detail in connection with preferred embodiments with reference to the accompanying drawings.

Figure 1:
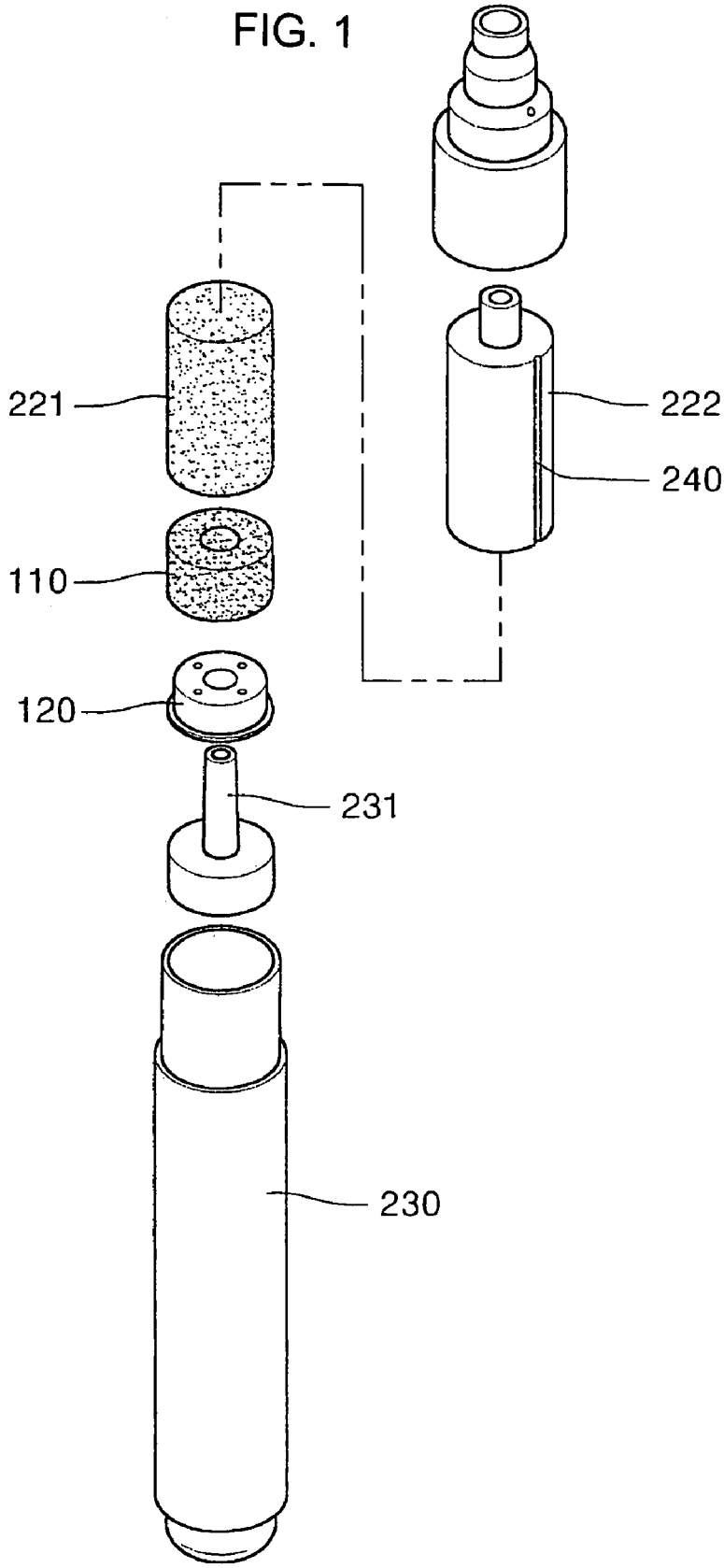
FIG. 1 is a dismantled perspective view of a writing instrument according to an embodiment of the present invention.
Figure 2:
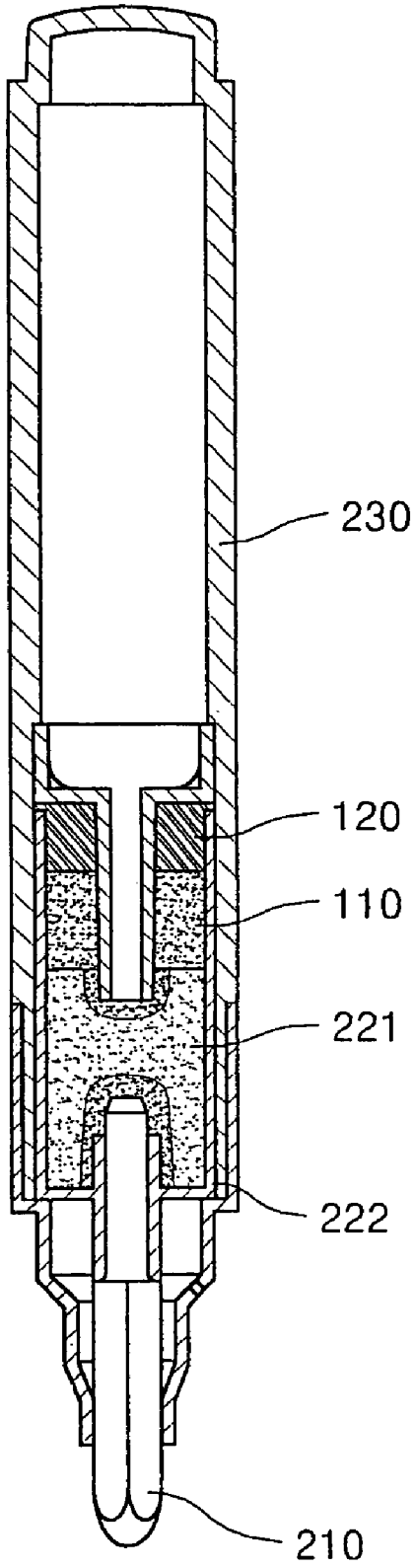
FIG. 2 is a cross-sectional view of the writing instrument shown in FIG. 1 according to an embodiment of the present invention.
Figure 3:
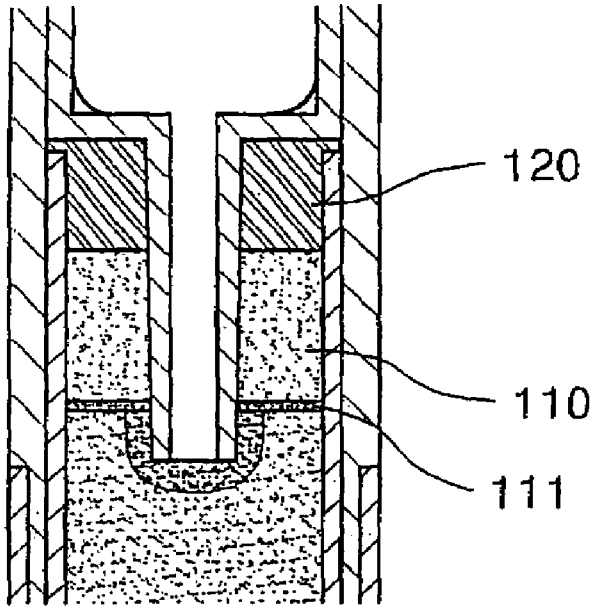
FIG. 3 is a detailed cross-sectional view of the writing instrument according to the present invention.
Figure 4:
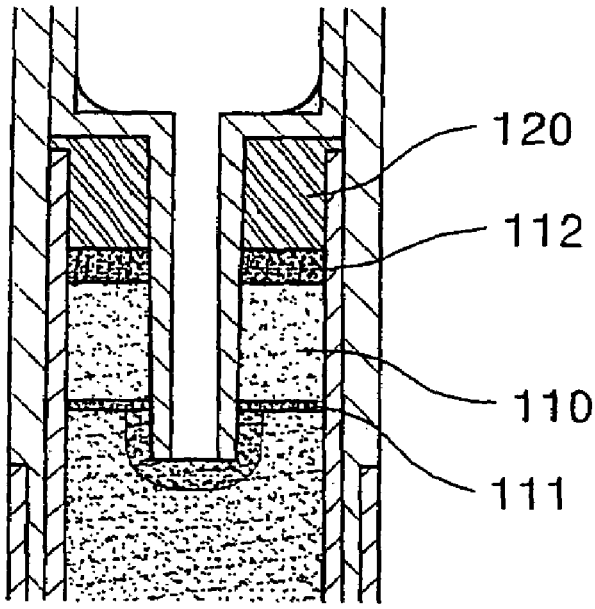
FIG. 4 is a detailed lateral cross-sectional view of the writing instrument according to the present invention.

FIG. 1 is a dismantled perspective view of a writing instrument according to an embodiment of the present invention. FIG. 2 is a cross-sectional view of the writing instrument shown in FIG. 1 according to an embodiment of the present invention. FIG. 3 is a detailed cross-sectional view of the writing instrument according to the present invention. FIG. 4 is a detailed lateral cross-sectional view of the writing instrument according to the present invention.

The present invention discloses a writing instrument capable of preventing an air passage 240 from being stopped by ink, which is drained out due to volume expansion, shock flow, etc. of the ink, which is caused by variation in temperature, and preventing the ink from flowing outside the body.

Referring to FIG. 1 to 4, the writing instrument includes an ink intake retainer body 221 for temporarily storing ink of an ink tank 230 and then supplying the ink, a tubular drawing tip 210 for drawing the ink of the ink tank 230 by way of the capillary phenomenon for writing purpose, an air passage 240 through which air for enabling the ink to flow from the ink intake retainer body 221 to the tubular drawing tip 210 passes, and an ink drain restriction body 110 for temporarily storing the ink introduced because of volume expansion, shock flow, etc. and then supplying the ink, wherein the ink drain restriction body 110 is disposed on the air passage 240 of the ink intake retainer body 221, and is formed using a foam having large porosities and a low density such that the absorption force of the ink drain restriction body 110 is lower than that of the ink intake retainer body 221. The ink intake retainer body 221 may includes a case 222 for enclosing the ink intake retainer body 221 as shown in FIGS. 1 and 2, and the air passage 240 may be provided along the surface of the case 222.

In the above, the ink drain restriction body 110 has a central portion of a perforated donut shape, which can be inserted into the circumference of a projected ink drain tube 231 for supplying the ink drained from the ink tank 230 to the ink intake retainer body 221.

Meanwhile, according to an embodiment of the present invention, the writing instrument further includes an anti-absorption layer 111 on which a surface-active agent is coated. The anti-absorption layer 111 is formed between part of the ink intake retainer body 221 and the ink drain restriction body so that, in normal times, the ink absorbed in the ink intake retainer body 221 can be prevented from flowing into the ink drain restriction body 110 by way of the capillary flow.

Furthermore, according to an embodiment of the present invention, the writing instrument further includes a drain interception body 112 for preventing the ink absorbed in the ink drain restriction body 110 due to volume expansion or shock flow of the ink from introducing into the air passage 240 due to wetting by viscosity with the body. The drain interception body 112 has porosities, which are denser than those in the ink drain restriction body 110, and is disposed on part of the ink drain restriction body 110.

Moreover, the writing instrument further includes a retaining tubular cap 120 for precluding the ink introduced due to volume expansion or shock flow. The retaining tubular cap 120 is provided in the rear of the ink drain restriction body 110.

As described above, the writing instrument of the present invention includes the ink intake retainer body 221 for temporarily storing ink of the ink tank 230 and then supplying the ink, the tubular drawing tip 210 for drawing the ink of the ink tank 230 by way of the capillary phenomenon for writing purpose, the air passage 240 through which air for enabling the ink to flow from the ink intake retainer body 221 to the tubular drawing tip 210 passes, and the ink drain restriction body 110 for temporarily storing the ink introduced because of volume expansion, shock flow, etc. and then supplying the ink, wherein the ink drain restriction body 110 is disposed on the air passage 240 of the ink intake retainer body 221, and is formed using a foam having large porosities and a low density such that the absorption force of the ink drain restriction body 110 is lower than that of the ink intake retainer body 221. If the ink stored in the ink intake retainer body 221 is expanded due to variation in ambient temperature, the expanded ink is absorbed in the ink drain restriction body 110. It is therefore possible to prevent the expanded ink from being drained out through the tubular drawing tip 210 by means of pressure, etc. and the air passage 240 from being stopped because of the expanded ink.

Furthermore, if the writing instrument according to the present invention is carried upside down, even ink introduced by its weight, ink flowed by shock, etc. is temporarily absorbed in the ink drain restriction body 110 and is then supplied to the ink intake retainer body 221.

As described above, the anti-absorption layer 111 on which the surface-active agent is coated is formed in the ink drain restriction body 110 on the part of the ink intake retainer body 221. Therefore, the ink drain restriction body 110 can be prevented from becoming wet due to the ink while using the writing instrument.

In addition, as stated previously, the drain interception body 112 or the retaining tubular cap 120, which has the dense porosities, is formed in the rear of the ink drain restriction body 110. It is thus possible to effectively prevent the outflow of ink, which is temporarily absorbed/stored by/in the ink drain restriction body 110.

Furthermore, during the course of assembling the ink intake retainer body 221, the portion where the ink drain tube 231 and the tubular drawing tip 210 come in contact with each other becomes dense by means of pressure in such a way that the capillary force strengthens. It is thus possible to uniformly drain out the ink through the tubular drawing tip. Also, the ink of the ink tank 230 can be prevented from flowing into the ink intake retainer body 221, rapidly and excessively, due to shock weight.

As described above, according to the present invention, an ink drain restriction body for absorbing and storing ink, which is drained out toward an air passage due to volume expansion, shock flow, etc., is disposed in the rear of the ink intake retainer body. Accordingly, the present invention is advantageous in that it can prevent the stoppage of an air passage by ink, which is drained out toward the air passage, and can prevent ink from flowing outside the body.

Furthermore, an anti-absorption layer having a surface-active agent coated on is formed on the part of an ink intake retainer body of an ink drain restriction body. It is thus possible to prevent ink from flowing into an air passage, and to allow air to be supplied to the ink intake retainer body smoothly.

Also, a drain interception body, which has denser porosities than those in the ink drain restriction body, is provided on the part of the air passage of the ink drain restriction body. Therefore, ink, which is absorbed in the ink drain restriction body due to volume expansion, shock flow, etc., can be prevented from flowing into the air passage because of wetting by viscosity with the body.

Incidentally, a retaining tubular cap is disposed in the rear of the ink drain restriction body. Accordingly, ink introduced due to volume expansion, shock flow, etc. can be effectively prevented from flowing into the air passage.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A writing instrument including an ink intake retainer body for temporarily storing ink of an ink tank and then supplying the ink, a tubular drawing tip for drawing the ink of the ink tank by way of a capillary phenomenon for writing purpose, and an air passage through which air for enabling the ink to flow from the ink intake retainer body to the tubular drawing tip passes, comprising:

an ink drain restriction body for temporarily storing the ink introduced because of volume expansion, shock flow, etc. and then supplying the ink, wherein the ink drain restriction body is disposed on the air passage of the ink intake retainer body, and is formed using a foam having large porosities and a low density such that the absorption force of the ink drain restriction body is lower than that of the ink intake retainer body, further comprising a retaining tubular cap for precluding the ink introduced due to volume expansion or shock flow, wherein the retaining tubular cap is provided in the rear of the ink drain restriction body.

2. A writing instrument including an ink intake retainer body for temporarily storing ink of an ink tank and then supplying the ink, a tubular drawing tip for drawing the ink of the ink tank by way of a capillary phenomenon for writing purpose, and an air passage through which air for enabling the ink to flow from the ink intake retainer body to the tubular drawing tip passes, comprising:

an ink drain restriction body for temporarily storing the ink introduced because of volume expansion, shock flow, etc. and then supplying the ink, wherein the ink drain restriction body is disposed on the air passage of the ink intake retainer body, and is formed using a foam having large porosities and a low density such that the absorption force of the ink drain restriction body is lower than that of the ink intake retainer body, further comprising an anti-absorption layer on which a surface active agent is coated so as to prevent the ink absorbed in the ink intake retainer body from flowing into the ink drain restriction body by way of the capillary flow, wherein the anti-absorption layer is formed between part of the ink intake retainer body and the ink drain restriction body.

3. The writing instrument as claimed in claim 2, further comprising a retaining tubular cap for precluding the ink introduced due to volume expansion or shock flow, wherein the retaining tubular cap is provided in the rear of the ink drain restriction body.

4. A writing instrument including an ink intake retainer body for temporarily storing ink of an ink tank and then supplying the ink, a tubular drawing tip for drawing the ink of the ink tank by way of a capillary phenomenon for writing purpose, and an air passage through which air for enabling the ink to flow from the ink intake retainer body to the tubular drawing tip passes, comprising:

an ink drain restriction body for temporarily storing the ink introduced because of volume expansion, shock flow, etc. and then supplying the ink, wherein the ink drain restriction body is disposed on the air passage of the ink intake retainer body, and is formed using a foam having large porosities and a low density such that the absorption force of the ink drain restriction body is lower than that of the ink intake retainer body, further comprising a drain interception body for preventing the ink absorbed in the ink drain restriction body due to volume expansion or shock flow of the ink from introducing into the air passage due to wetting by viscosity with the body, wherein the drain interception body has porosities, which are denser than those in the ink drain restriction body, and is disposed on part of the ink drain restriction body.

5. The writing instrument as claimed in claim 4, further comprising a retaining tubular cap for precluding the ink introduced due to volume expansion or shock flow, wherein the retaining tubular cap is provided in the rear of the ink drain restriction body.

6. A writing instrument including an ink intake retainer body for temporarily storing ink of an ink tank and then supplying the ink, a tubular drawing tip for drawing the ink of the ink tank by way of a capillary phenomenon for writing purpose, and an air passage through which air for enabling the ink to flow from the ink intake retainer body to the tubular drawing tip passes, comprising:

an ink drain restriction body for temporarily storing the ink introduced because of volume expansion, shock flow, etc. and then supplying the ink, wherein the ink drain restriction body is disposed on the air passage of the ink intake retainer body, and is formed using a foam having large porosities and a low density such that the absorption force of the ink drain restriction body is lower than that of the ink intake retainer body, further comprising an anti-absorption layer on which a surface active agent is coated so as to prevent the ink absorbed in the ink intake retainer body from flowing into the ink drain restriction body by way of capillary flow, wherein the anti-absorption layer is formed between part of the ink intake retainer body the the ink drain restriction body; and a drain interception body for preventing the ink absorbed in the ink drain restriction body due to volume expansion or shock flow of the ink from introducing into the air passage due to wetting by viscosity with the body, wherein the drain interception body has porosities, which are denser than those in the ink drain restriction body, and is disposed on part of the ink drain restriction body.

7. The writing instrument as claimed in claim 6, further comprising a retaining tubular cap for precluding the ink introduced due to volume expansion or shock flow, wherein the retaining tubular cap is provided in the rear of the ink drain restriction body.

* * * * *